US006433787B1

(12) United States Patent
Murphy

(10) Patent No.: US 6,433,787 B1
(45) Date of Patent: Aug. 13, 2002

(54) DYNAMIC WRITE-ORDER ORGANIZER

(76) Inventor: Nicholas J. N. Murphy, Long Hill House, Long Hill, The Sands, Surrey GU10 INQ. (GB)

( * ) Notice: Subject to any disclaimer, the term of this patent is extended or adjusted under 35 U.S.C. 154(b) by 0 days.

(21) Appl. No.: 09/266,052

(22) Filed: Mar. 10, 1999

Related U.S. Application Data

(60) Provisional application No. 60/109,566, filed on Nov. 23, 1998.

(51) Int. Cl.[7] ..... G09G 5/36

(52) U.S. Cl. ..... 345/556; 345/558

(58) Field of Search ..... 345/558, 530, 345/531, 556, 564; 711/100, 126, 141–145, 154; 710/52, 55

(56) References Cited

U.S. PATENT DOCUMENTS

| | | | | |
|---|---|---|---|---|
| 5,561,780 A | | 10/1996 | Glew et al. | 711/126 |
| 5,630,075 A | | 5/1997 | Joshi et al. | 711/100 |
| 5,671,444 A | | 9/1997 | Akkary et al. | 710/52 |
| 5,751,996 A | | 5/1998 | Glew et al. | 711/145 |
| 5,872,990 A | * | 2/1999 | Luick et al. | 712/24 |
| 5,918,005 A | * | 6/1999 | Moreno et al. | 714/38 |
| 6,122,715 A | * | 9/2000 | Palanca et al. | 711/154 |

OTHER PUBLICATIONS

"Write Combining Memory Implementation Guidelines" by Intel, Nov. 1998.*

* cited by examiner

*Primary Examiner*—Kee M. Tung

(57) ABSTRACT

A buffer and table structure for reordering out-of-order evictions from a write-combine buffer. In a preferred embodiment, a first-in first-out (FIFO) buffer is used.

27 Claims, 6 Drawing Sheets

DYNAMIC WRITE-ORDER ORGANIZER

CROSS REFERENCE TO RELATED APPLICATIONS

This application claims priority from Ser. No. 60/109,566, filed Nov. 23, 1998.

BACKGROUND AND SUMMARY OF THE INVENTION

The present invention relates to processing information received from a microprocessor, particularly to reordering out-of-order data by means of a table structure.

Background: First-In, First-Out (FIFO) Structures

FIFO structures are used in computers for various functions such as buffering and pipelining. A FIFO structure is one in which the first object put into the structure is also the first object that must come out. A physical example is rolling marbles through a pipe. The first marble that goes into the pipe is also the first one that must come out the other end. Thus the pipe can be thought of as a FIFO structure.

Background: Video Graphics Terminals

Since the first computer display was attached to MIT's Whirlwind computer in 1950, enormous advances have been made in the systems generating graphical pictures and in the display hardware which enables users of the system to view and interact with the pictures. Because the graphics display forms a large part of the physical user interface of the system, the evolution of display technology has been a major contributing factor in the growth of the computer industry.

Video graphics terminals, also known as graphics displays, show pictures and text. Familiar examples are computer monitors or television sets. Visually, one may think of a screen of the video display as constructed of many small "dots" called pixels. The smallest object that can be shown on the video display screen is one pixel.

A modern computer monitor, for example, may have a rectangular screen 1,280 pixels wide by 1,024 pixels high. Therefore the screen would contain over one million pixels (1,024×1,024). In a video terminal, each pixel generally requires storage or transmission of data about its properties, such as its color and brightness. For some computer monitors, a pixel's properties may be stored in one byte. Because one byte usually allows only 256 color choices, other monitors a and graphics processors may use more than one byte of memory to store information about a pixel. In any event, more than one million bytes might have to be transmitted over a computer bus to update a 1280×1024 computer screen one time. The computer screen might be updated thirty times each second if full-motion video is displayed. This means that at least thirty million bytes of pixel information might cross the computer bus every second for display of full-motion video.

Background: Write-Combine-Operations

Sending thirty million bytes of pixel information per second over the computer bus is not desirable because it ties up the bus. The computer cannot use the bus for other purposes while the pixel-bytes are being transmitted. For example, on a 66 MHz byte-wide bus, almost half the available transmission capability would be used. Further complicating the matter is the fact that each pixel-byte usually has "overhead" bytes transmitted along with it. The "overhead" bytes contain addressing information to make sure that the pixel-byte gets to the correct destination. The overhead bytes use even more of the bus transmission capability, leaving little or no room for the computer's other communication needs.

One solution to the problem of these extra "overhead" bytes is to chain several related pixel-bytes together and transmit them in one transaction (known as a burst transaction). This is called write-combining because several individual bus writes have been combined into one bus write. The number of pixel-bytes is not reduced but the number of "overhead" bytes is reduced. A write-combine transmission may only require the same number of overhead bytes as a single pixel-byte transmission. As an example, currently some microprocessors may combine thirty-two pixel-bytes into one write-combine transmission. Thus thirty-two pixel-bytes are transmitted with approximately a ninety-seven percent reduction in "overhead" bytes.

The individual pixel-bytes are stored, one at a time, in a write-combine buffer. When certain conditions are satisfied, the contents of the buffer are evicted onto the computer bus. One feature of write-combine buffers, for example in the INTEL PENTIUM II architecture, is that if the size of the write-combine buffer is larger than the size of a discrete transfer on a bus, the order in which contents of the buffer are evicted to the bus is generally undefined. In essence, this means that the contents of the buffer are not necessarily put on the bus in the order in which they were written.

This re-ordering of the write-combine buffer contents generally does not matter when writing to memory, such as a frame buffer, because the final result will be the same. However, the re-ordering becomes important when writing to a FIFO buffer because the output of the FIFO must be used in sequence. In other words, when writing to an array of memory such as a frame buffer, the write order doesn't necessarily matter because the memory may only be accessed after all the writes are finished. When writing to a FIFO, order matters because the current output must be used sequentially before the next one becomes available (returning to the pipe example, the marble showing at the end of the pipe must be removed before the next one can come out).

FIG. 2 displays a typical write-combine buffer, as implemented in an INTEL PENTIUM PRO processor. In the embodiment shown, a write-combining buffer 200 is comprised of a single line having a data portion 210, a tag portion 220 and a validity portion 230. The data portion 210 can store up to 32 bytes of user data. The validity portion 230 is used to store valid bits corresponding to each data byte of data portion 210. The valid bits indicate which of the bytes of data portion 210 contain useful data.

When a microprocessor writes to a location in a write-combine buffer that is already occupied, the contents of the buffer are evicted. Some eviction (aka flushing) schemes, such as employed by the INTEL PENTIUM PRO, allow for partial eviction of the write-combine buffer. For example, instead of evicting the contents of its entire 32 byte buffer, a microprocessor may only evict 8 bytes. What this means is that it is possible for writes to be evicted to the bus out-of-order. The evicted 8 bytes in the example above could "jump" ahead of other contents of the write-combine buffer.

Background: Frame Buffers

A frame buffer is memory that contains a digital representation of an image to be displayed on a monitor. A typical frame buffer will contain one byte of color information about each pixel in the monitor screen. A microprocessor writes the image data into the frame buffer, creating a virtual image. When the frame buffer is filled, the virtual image is output to the monitor through video circuitry to produce a viewed image on the monitor. Because the frame buffer is not used until it is full, it does not matter in what sequence the pixel color bytes are written to the frame buffer.

Background: Memory-mapped I/O

A common method for microprocessors to communicate with Input-Output (I/O) devices is memory-mapping. Essentially memory-mapped I/O means that certain areas of a microprocessor's memory address space are reserved for communications with I/O devices. A video graphics card is one example of an I/O device that is generally memory-mapped. For the purpose of writing data, memory-mapping allows the microprocessor to treat the I/O device as if it were memory.

Background: Graphics Processors

Originally, calculations needed to display graphics were handled exclusively by the microprocessor. As video graphics demands became greater, the microprocessor devoted a larger percentage of its time to handling graphics calculations. To ease this burden on the to microprocessor, a separate graphics processor is generally used to handle graphics calculations.

The graphics processor is often a memory-mapped device. When writing to a graphics processor, microprocessors typically "see" the graphics processor as frame buffer memory. This means that the microprocessor "thinks" that it is writing data to memory, not to a graphics processor, and strict sequential ordering is unimportant. In fact, it is actually writing data and commands to the graphics processor. If the sequence of commands to the graphics processor is not maintained, unpredictable behavior by the computer will result. Thus, order of writes to a graphics processor is very important.

As discussed above, write-combine buffers can evict data to the bus out of order. Without some method of reordering the data, a memory-mapped graphics processor is unable to take advantage of the benefits of microprocessor write-combining.

Dynamic Write-order Organizer

Write combining is a mechanism used by some CPUs to improve the speed at which they can transfer data to memory or another device. A write-combine transfer means that multiple writes have been combined to form a single write, so the transfer can be done more efficiently. In general, the mechanism implemented by the CPU combines all writes within an address range (typically 32 bytes), and any write outside this range (or other event) causes the combined write to be flushed. If the size of the write combining buffer is larger than the size of a discrete transfer on the bus, the order in which the contents of the buffer are flushed is generally undefined because partial writes are used to flush the buffer.

The re-ordering of data generally does not matter when writing to memory, such as a frame buffer, because the final result is the same. The order of writes does matter when writing to a buffer of a graphics processor, however, because the data may be commands that must be executed in a specific order by the graphics processor. A dynamic write-order organizer re-orders the data and commands written to a FIFO buffer so that they may be executed in the proper order.

Although a FIFO may be loaded by writing to a single address, it is common practice to use a base address and offset addresses for subsequent writes. This practice produces more efficient transfers on certain types of buses (e.g. PCI). In the preferred embodiment, the dynamic write-order organizer uses offset addressing because offset addresses are desirable as an indication of the ordering of the writes.

In the presently preferred embodiment, when the data is written to the FIFO, the offset address bits are stored in the FIFO alongside the data (the number of bits in the offset address depends on the size of the write-combine buffer). When data is read from the FIFO it is written directly into a table; the address alongside the data in the FIFO is used as the index into the table. Each entry in the table also has a flag to mark the validity of the entry. If the flag is valid (True) for the entry to be written to, the write stalls until the flag is cleared by the read process. When the write completes the flag is set to True.

In the presently preferred embodiment, a separate process At continually attempts to read from the table, starting at the first location (which corresponds to the base address +zero offset). The read is not allowed to happen until the valid flag is set True. When the first location is valid, it is read and the data passed on as though it had been read from the FIFO, and the flag cleared to False. The read index is o incremented and the valid flag tested again. This procedure is repeated until the end of the table has been reached and then starts again at the first entry.

Without a safety check, a programming error could cause this mechanism to lock-up. If the addresses used are not consecutive the read process will stall waiting for a write that will never arrive, and the write process will stall waiting for an entry to clear that will never be read. This condition is detected by testing the flags of all entries in the table between the entry being read and the entry where the write process is stalled trying to write. If there are any invalid flags between these two entries, a programming error has been detected and the table entries are reset.

The disclosed innovations, in various embodiments, provide one or more of at least the following advantages:

- re-ordering data so that commands evicted from a write-control buffer may be executed in the order written by a microprocessor
- a safety check to detect programming errors and information loss
- a general method of reordering information written to a buffer for systems that use write-combining buffers
- a reduction in bus traffic due to ability to use write-combining features of modern microprocessors for graphics operations

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

Figure 1:
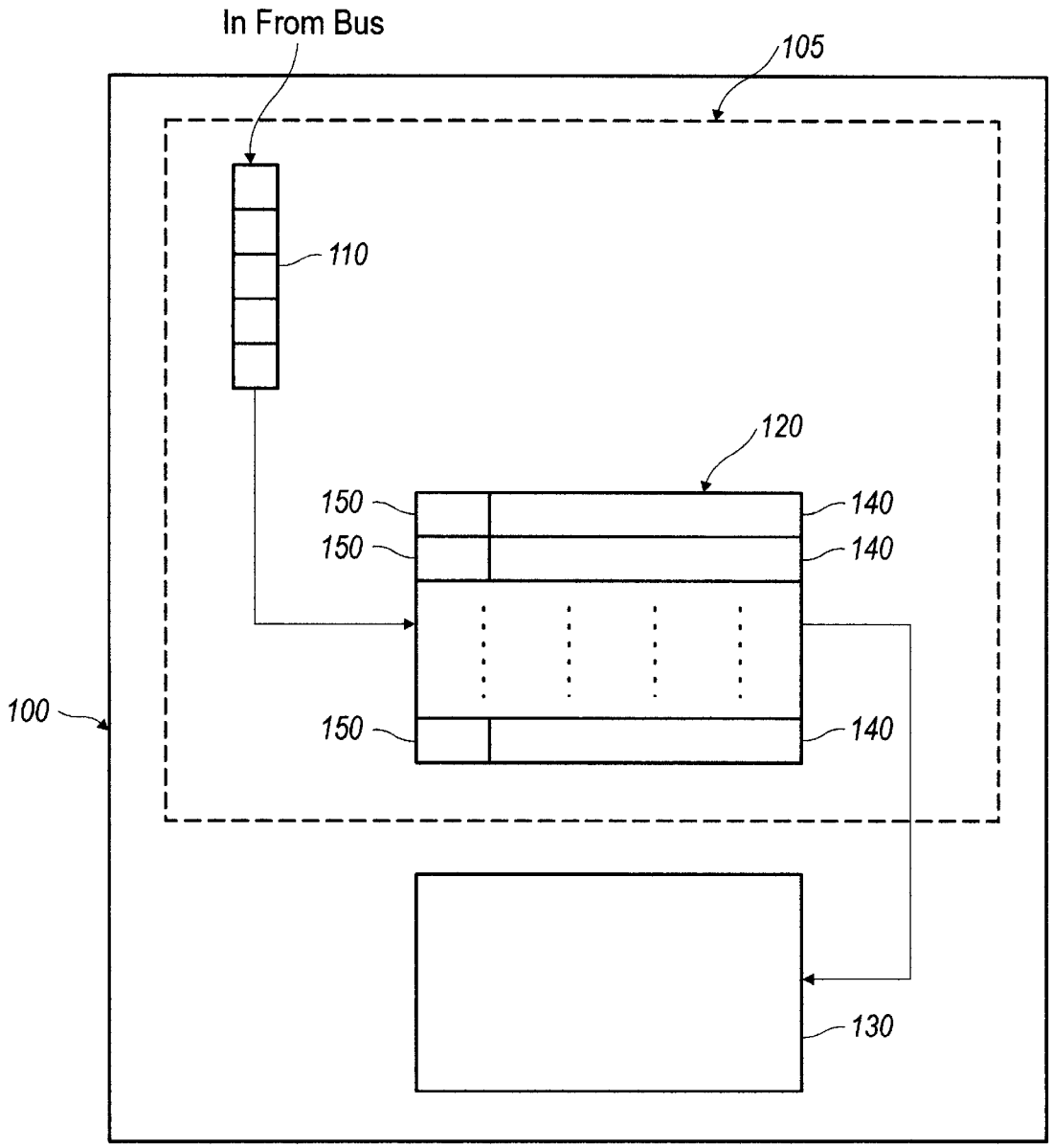
FIG. 1 displays a block diagram of a graphics processor incorporating a dynamic write-order organizer.
Figure 2:
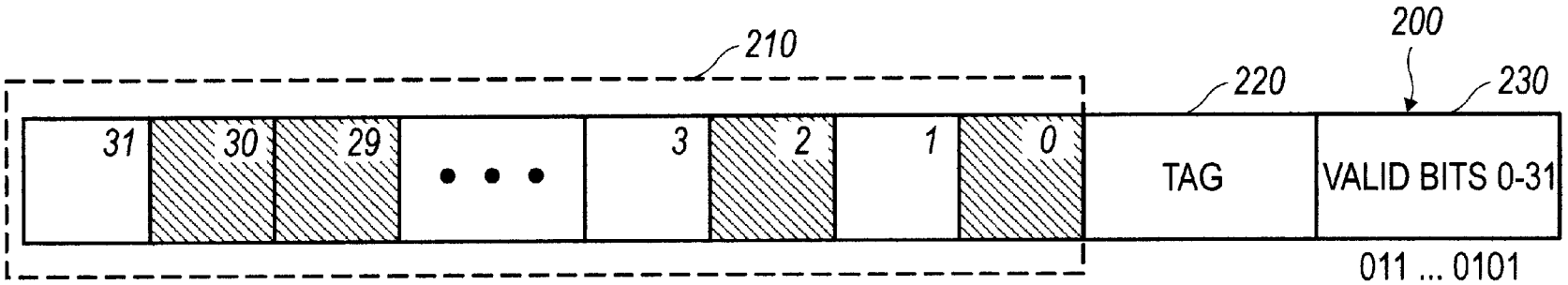
FIG. 2 shows a related art write-combine buffer.

The numerous innovative teachings of the present application will be described with particular reference to the presently preferred bodiment (by way of example, and not of limitation).

Definitions:

Following are short definitions of the usual meanings of some of the technical terms which are used in the present application. (However, those of ordinary skill will recognize whether the context requires a different meaning.) Additional definitions can be found in the standard technical dictionaries and journals.

Accelerated Graphics Port (AGP): A high-bandwidth computer bus architecture. AGP uses a combination of frame buffer memory local to the graphics controller, as well as system memory, for graphics data manipulation and storage.

Base Address: A computer memory addressing scheme in which a particular memory location is located by a base address and an offset. For example, a byte of memory located at 250016 may have a base address of 250000 and an offset of 16 from the base address.

BIOS: Basic Input/Output Services. Standardized software services that allow uniform programming of computers made by different manufacturers. Essentially this allows each manufacturer to design unique hardware (video cards for example) yet still present a uniform interface to programs being run on the computer.

Buffer: Usually a temporary storage location for data and commands. Buffers are often used in situations where a processor may not be able to accept data from a bus. If the processor is busy with other tasks, the bus may have to hold the data until it can be accepted. This ties up the bus so that none of the other system components may communicate over it. Use of a buffer allows the data to be loaded from the bus and used when the processor is ready.

Burst Mode: Placing data on a bus at high (burst) speed. Usually preceded by temporarily dedicating a general purpose bus to a single device.

Bus: An electrical signal pathway over which power, data, and other signals travel. Several components of a computer system may be connected in parallel to a bus so that signals can be passed between them.

Byte: Generally defined as eight bits, although some systems may differ.

Cache: Local memory that allows information to be accessed quickly, as opposed to remote system memory which is slower to access.

Cache hit: A data or instruction cycle in which the information being read or written is currently stored in that cache.

Computer Graphics Adapter: Accepts information from a microprocessor and generates signals to display information on a monitor. May have an on-board processor or on-board memory to improve video speed.

Data: As used in this application, may refer to data and commands.

Demultiplex (DEMUX): Usually, to connect any one of multiple inputs to one output. A DEMUX has fewer outputs than inputs. A commonly available commercial unit is a 8:1 DEMUX, meaning it has eight inputs that may be routed to one output.

Double Word: Generally defined as two words. In the case of a thirty-two bit word, a double word would be sixty-four bits or eight bytes in length.

Eviction: All or a portion of the data within a buffer is read and transmitted from the buffer. Usually the data is evicted onto a bus.

Flush: see Eviction.

Frame Buffer: A memory array where information about the color of each pixel on a computer monitor is stored. Display memory that temporarily stores (buffers) a full frame (screen) of picture data at one time. Sometimes referred to as a bitmap. If one byte (allowing a choice of 256 colors) is used to describe each pixel, a 12804×1024 monitor would require a frame buffer of greater than one megabyte (1,000,000 bytes).

Graphics Adapter: See computer graphics adapter.

Graphics Board: See computer graphics adapter.

Multiplex MUX: Usually, to connect one input to any one of multiple outputs. A MUX has more outputs than inputs. A commonly available commercial unit is an 1:8 MUX, meaning it has one input that may be routed to one of eight possible outputs.

Partial Write: Evicting part of write-combine buffer, as opposed to evicting all of the contents of the buffer. For example, in a 32 byte size buffer, a partial write may evict only eight or sixteen bytes.

Pixel: A point on a computer screen. Short for PIcture ELement. The smallest unit that can be addressed and given a color or intensity. A pixel's properties may be represented by some number of bits (usually 8, 16, or 24) in a frame buffer.

Random-access memory (RAM): Memory that may be read or written, and in which the access time to any bit of information is independent of the address of that item. Often used for temporary storage of data or commands because RAM generally loses its contents when power is removed.

Read-only memory (ROM): Memory that may only be accessed for read operations, not writes. Often used for long-term storage of data or commands because ROM retains its contents after power is removed.

Setting or resetting a flag: Generally means writing a 1 (setting) or 0 (resetting) to a flag location, for the purpose of signifying that an to event has or has not taken place.

Video Card: See computer graphics adapter.

Video random-access memory (VRAM: A fast type of RAM optimized for video applications.

Word: Generally defined as two bytes. Another common definition is four bytes. The length of a word depends on the parameters of the system in which it is used.

Write: To cause data or commands to be recorded in some form of storage. Used as a noun in some contexts in this specification and claims to refer to the individual write operation that is combined in the write-combine buffer.

Write-back cache: In a write-back configuration, when a CPU writes data to memory, the cache is updated, not the main memory. Main memory is updated only when the data is discarded from the cache.

Write-through cache: In a write-through configuration, when the CPU writes data to memory, both the cache and main memory are updated simultaneously.

Write-combine buffer: A buffer which may combine several discrete write operations into one "package" so that they can be put onto the data bus in the same operation. Several small write operations (e.g., string moves, string copies, bit block transfers in graphics applications, etc.) may be combined by a write-combining buffer into a single, larger write operation. Because each individual write operation requires significant "overhead" such as address information, combining several write operations into one reduces overall "overhead" and is more efficient. The write-combining function is generally used as an architectural extension to a cache system and a write-combine buffer may be implemented as part of a cache unit.

Graphics Processor Embodiment

FIG. 1 shows a graphics processor 100. Internal to the graphics processor 100 is a dynamic write-order organizer 105, incorporating a FIFO 110 and a table structure 120. FIFO 110 accepts information from a bus. The output of the FIFO 110 is written to a table structure 120. The FIFO 110 output is written to the table 120 according to its offset address. Each location in the table contains a flag section 150 and a data section 140. A value stored in the flag section indicates whether that location has been written to. Data or commands may be written to the data section 140. As each data section 140 is written, its corresponding flag section 150 is updated.

Reordering Out-of-order Data

A process attempts to read the contents of the first location in the table 120. First, the flag section 150 is checked. If the flag has been set, the process may read the contents of the data section 140, reset the flag, and proceed to the next location in the table. If the flag has not been set, the read process must wait at this location until it has been written to. After the location has been written to, the flag is set and the data section 140 may be read.

Before writing to a location, the status flag 150 is checked to verify that the location is vacant (flag is reset). If the status flag 150 is not set, the location is vacant and may be written to. If the status flag 150 is set, the data section 140 contains information that has not been read by the graphics core 130. Because FIFOs output sequentially, the FIFO 110 will stall at this location until the status flag 150 corresponding to the target data section 140 is cleared by the read operation. Similarly, before reading a location, the status flag 150 is checked to verify that the location is occupied (flag is set).

Lockup

The use of semaphores to control reading and writing of the table 120 makes possible a situation in which lockup may occur. Because both the read and write operations may stall, a safety check is necessary to detect lockup conditions caused by programming errors or loss of data on the bus. A lockup condition occurs when the write operation is stalled at one location and the read location has stalled at a second location. The write cannot continue until the first location has been read but the read cannot continue until the second location has been written. Each waits for the other and neither may proceed.

The safety-check is performed when the write operation by FIFO 110 stalls. Essentially the safety check verifies that the CPU has Ad written to consecutive addresses so that there are no gaps in the addresses written to. The status flags are checked for each location from the one currently being read to the location where the write is stalled. If any status flags are not set (indicating that the read will stall when it gets to that point) then a lockup condition has been detected.

When the safety-check detects a lockup condition, the status flag of every location in the table is reset and the read process is reset to begin at the first location in the table. An interrupt may be optionally generated to alert the CPU to the error. Any data or commands in the table are lost. Effectively, the table is wiped clean, the FIFO 110 may resume writing to the table, and the read process begins again at the first location.

Dynamnic Write-order Organizer

Figure 3:
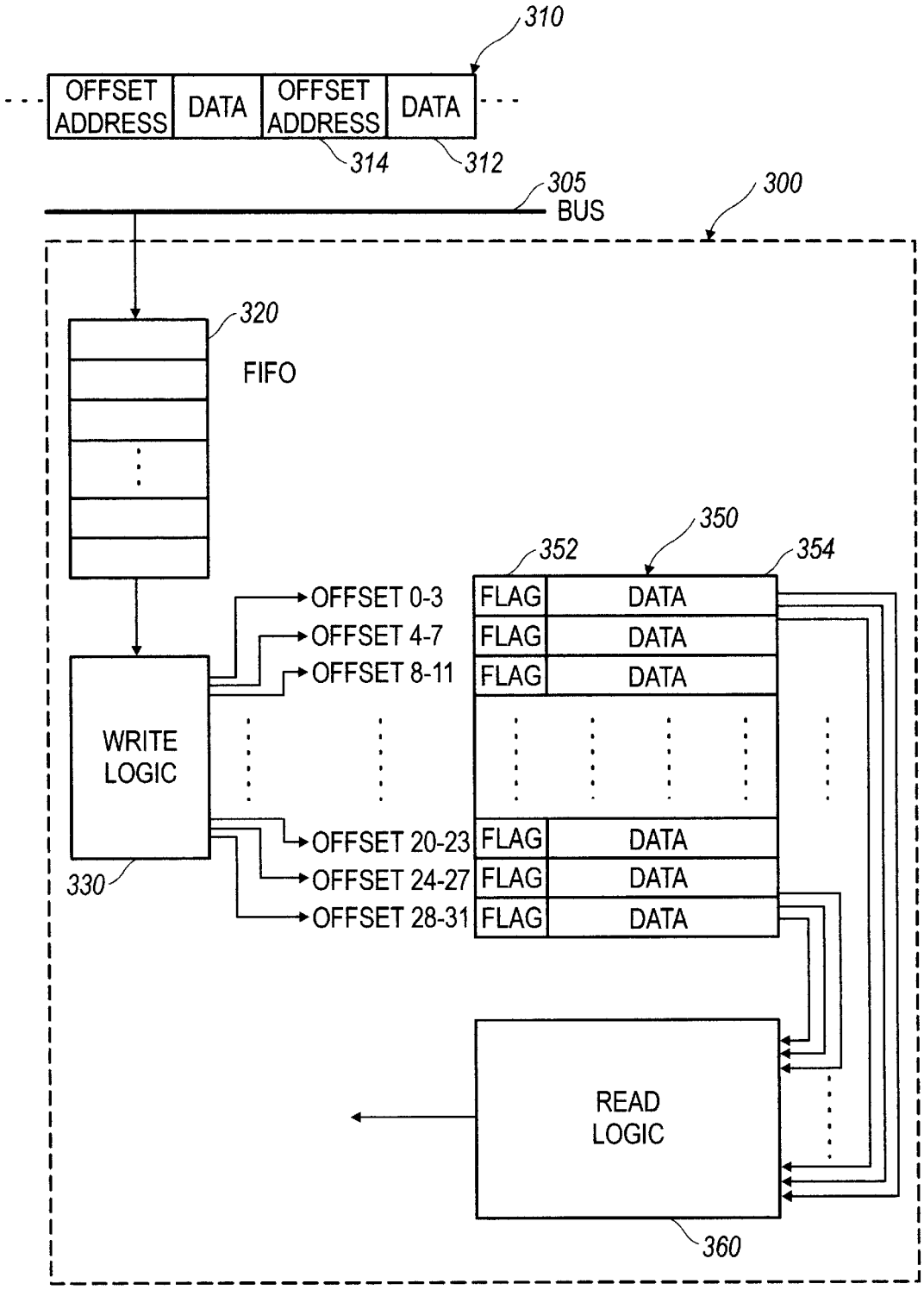
FIG. 3 shows a preferred embodiment of a dynamic write-order organizer.

FIG. 3 depicts an embodiment of a dynamic write-order organizer 300. A packet 310 from a write-combine buffer eviction is received by a FIFO 320. Each data element 312 has an associated offset address 314.

A write logic block 330 receives the data element 312 and offset address 314 from the FIFO 320. The offset address 314 is used as an index into a table 350. The logic block 330 locates a table entry having the same offset and checks a status flag 352 associated with that entry. If the status flag 352 is not set, the logic block 330 writes the data element 312 to the data portion 354 of the entry and sets the status flag 352.

In the preferred embodiment, the data portion 354 of each table entry has a granularity of four bytes because commands to a graphics processor have a granularity of four bytes. Thus, the table 350 has eight entry locations because the INTEL PENTIUM PRO write-combine buffer has 32 bytes. For example, evicted bytes having an offset of 0–3 would be placed in data portion 354 of the first entry location in table 350.

As a further example, assume FIFO 320 receives a partial eviction of data elements 312 having an offsets of 28 through 31 from a the base address. Write logic block 330 would check the flag 352 at the eighth entry location, which covers offsets of 28 through 31 from the start of the table. If the flag 352 has not been set, the data 312 is at written into the four byte data portion 354 and then the flag 352 is set. If the flag 352 is already set, the write logic 330 stalls at this entry until the read logic block 360 reads the data 354 and resets the flag 352.

A read logic block 360 reads data out of the table beginning at the entry which has an offset of zero from the base address. Before the data portion 354 of the entry can be read, the flag 352 is checked. If the flag 352 is not set, the read logic 360 is stalled at this entry and continues to check the flag until it is set. If the flag 352 is set, the data 354 is read, then the flag 352 is reset, and the read logic 360 proceeds to the next entry.

A lockup condition can occur when both the write logic 330 and read logic 360 have stalled. In the preferred embodiment, partial evictions before the write-combine buffer is filled are prevented by the programmer. Thus, the lockup condition typically only occurs when the entire contents of the write-combine buffer do not get to the dynamic write-order organizer. Normally, a lockup condition will only occur when there has been a programming error or data has been lost.

Lockups are avoided by use of a safety-check method. When the write logic 330 stalls, all the status flags 352 are checked between the entry being read and the entry at which the write logic 330 is stalled. If any of the status flags 352 in this region are reset, the read logic 360 will stall when it reaches that entry and a lockup will occur. To prevent a lockup, all of the status flags 352 for every table entry are reset and the read logic 360 returns to the entry with an offset of zero. The contents of the table 350 are effectively lost when this safety-check reset occurs.

Video Graphics Board Embodiment

Figure 5:
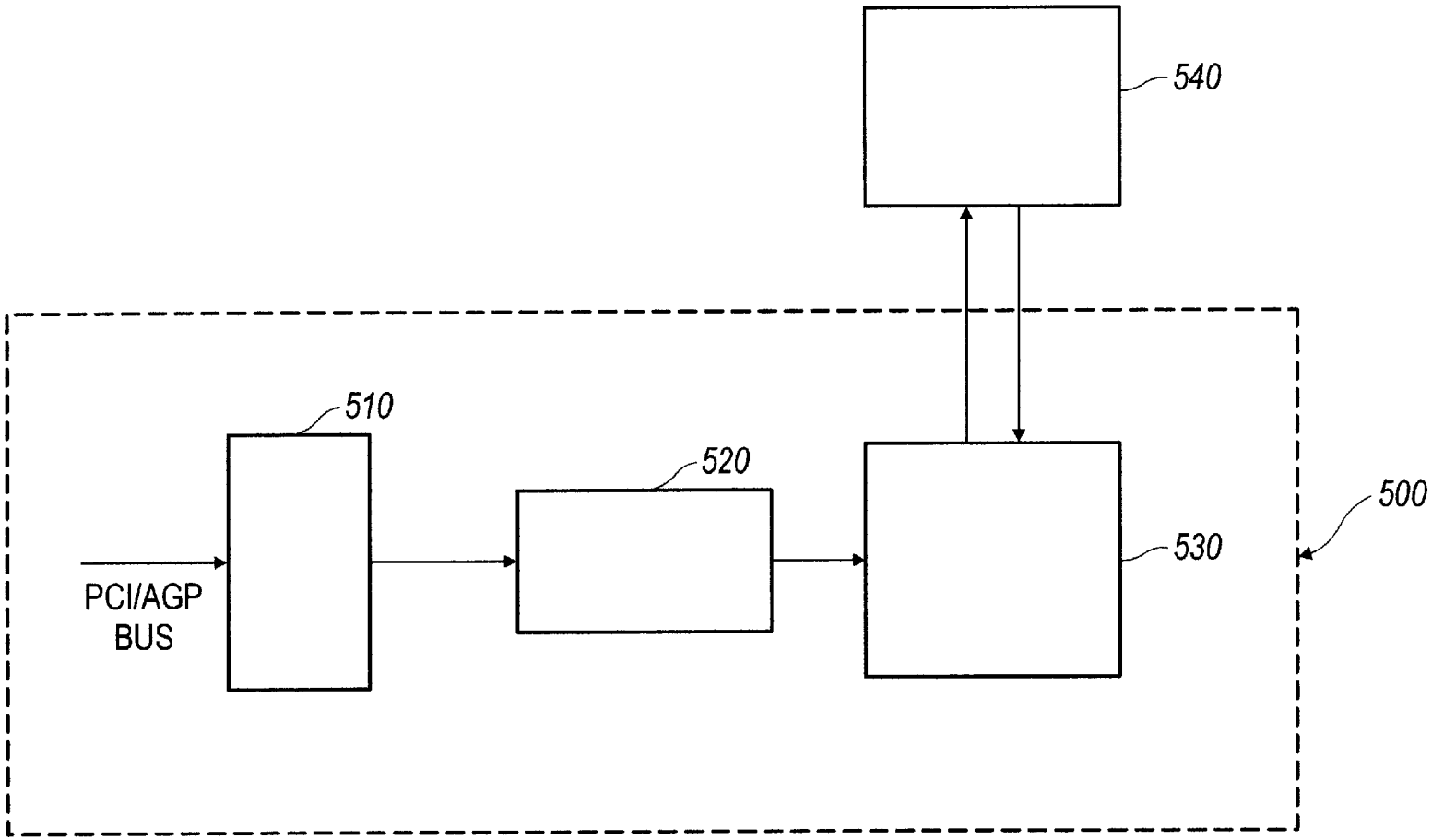
FIG. 5 depicts a graphics board incorporating a dynamic write-order organizer external to the graphics processor.

FIG. 5 shows a video graphics board incorporating a dynamic write-order organizer. In the embodiment shown, a PCI/AGP Interface 510 accepts data from the PCI/AGP Bus. A dynamic write-order organizer 520 is external to a Graphics Processor 530 and accepts data from the Interface 510. Processor 530 reads reordered data from the dynamic organizer 520, executes commands and stores data in system memory 540.

Permedia 3 Embodiment

Figure 6:
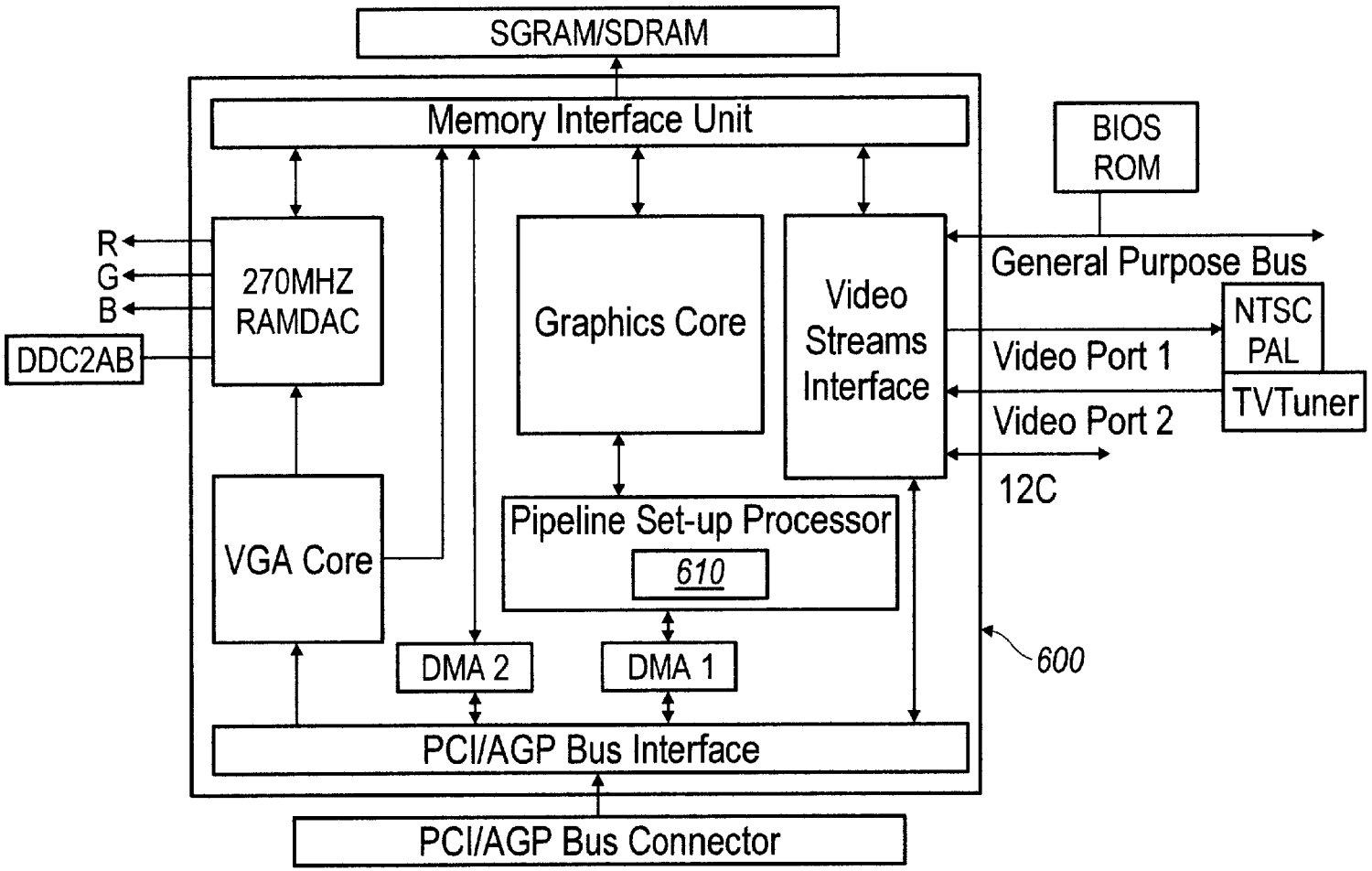
FIG. 6 shows a 3DLABS PERMEDIA 3 video graphics processor incorporating a dynamic write-order organizer.

FIG. 6 shows a 3DLABS PERMEDIA 3 video graphics processor 600 incorporating a dynamic write-order organizer 610. A PCI/AGP Interface accepts data from a PCI/AGP Bus Connector. Commands and data destined for Graphics Core are passed to DMA1. Graphics data bound for memory are passed to DMA2. Incorporated in Pipeline Set-up Processor, a dynamic write-order organizer 610 accepts the commands from DMA1 and reorders them in the sequence in which they were written to a write-combine buffer. Next, Graphics Core accepts and manipulates the reordered commands/data from Pipeline Set-up Processor.

Computer Embodiment

Figure 4:
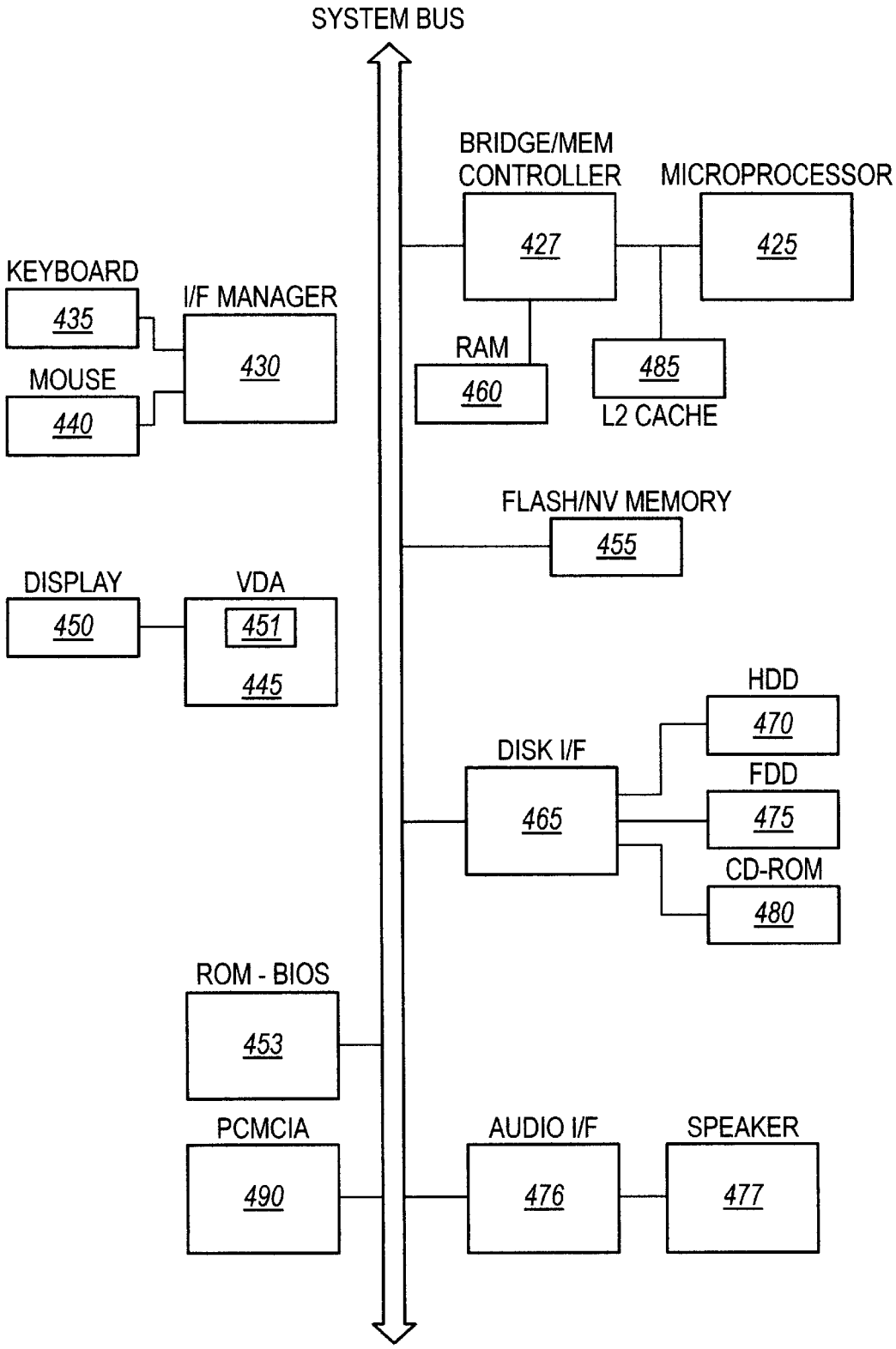
FIG. 4 shows a block diagram of a computer incorporating a dynamic write-order organizer.

FIG. 4 shows a computer incorporating an embodiment of the innovative dynamic write-order organizer 451 in a video display adapter 445. Naturally, the innovative dynamic write-order organizer 451 is not limited to use in the components shown and may be used where required by any component that connects to a bus. The complete computer system includes in this example: user input devices (e.g. keyboard 435 and mouse 440); at least one microprocessor 425 which is operatively connected to receive inputs from the input devices, across perhaps a system bus 431, through an interface manager chip 430 which provides an interface to the various ports and registers; the microprocessor interfaces to the system bus through perhaps a bridge controller 427; a memory (e.g. flash or non-volatile memory 455, RAM 460, and BIOS 453), which is accessible by the microprocessor; a data output device (e.g. display 450 and video display adapter card 445) which is connected to output data generated by the microprocessor 425; and a mass storage disk drive 470 which is read-write accessible, through an interface unit 465, by the microprocessor 425.

Optionally, of course, many other components can be included, and this configuration is not definitive by any means. For example, the computer may also include a CD-ROM drive 480 and floppy disk drive ("FDD") 475 which may interface to the disk interface controller 465. Additionally, L2 cache 485 may be added to speed data access from the disk drives to the microprocessor 425, and a PCMCIA 490 slot accommodates peripheral enhancements. The computer may also accommodate an audio system for multimedia capability comprising a sound card 476 and a speaker(s) 477.

According to a disclosed class of innovative embodiments, there is provided: A dynamic reordering system, comprising: a buffer functionally connected to receive data from a processor; and a dynamic reordering structure functionally connected to receive data from said buffer and dynamically reorder said data according to corresponding tags, wherein said structure will not permit out-of-order reads.

According to another disclosed class of innovative embodiments, there is provided: A dynamic write-order organizer, comprising: a buffer structure, having an input and an output; and a table structure, having a plurality of entry locations functionally connected to said output of said buffer structure, whereby every write evicted from a write-combine buffer may be stored in one of said entry locations; wherein said table structure incorporates a status flag for each of said entry locations and access circuitry to read said flag and block out-of-order reads.

According to another disclosed class of innovative embodiments, there is provided: A graphics processor, comprising: a video graphics core; and at least one input structure functionally connected to said video graphics core; wherein said input structure is a dynamic write-order organizer, said dynamic write-order organizer incorporating a table having a status flag for each table entry location and access circuitry to read said flag and block out-of-order reads.

According to another disclosed class of innovative embodiments, there is provided: A graphics adapter, comprising: a graphics processor incorporating a dynamic write-order organizer; and on-board memory; wherein said dynamic write-order organizer incorporates a table having a status flag for each table entry location and access circuitry to read said flag and block out-of-order reads.

According to another disclosed class of innovative embodiments, there is provided: A computer system, comprising: a user input a device; at least one microprocessor which is operatively connected to receive inputs from said input device and incorporates at least one write-combine buffer; a memory which is accessible by the microprocessor; a data output device for displaying information, functionally connected to said microprocessor; a magnetic disk drive which is operatively connected to the microprocessor; and a dynamic write-order organizer, for reordering out-of-order evictions from said write-combine buffer and preventing out-of-order reads, operatively connected between said microprocessor and said data output device.

According to another disclosed class of innovative embodiments, there is provided: A method of reconstructing the order of writes to a write-combine buffer, comprising the steps of: (a) receiving data into a buffer from a write-combine buffer; (b) writing said data from said buffer into a table entry location, according to address tags; (c) after writing to a table location, setting a flag to indicate that information has been loaded into said location; (d) beginning at a first location, checking whether its flag is set; (e) if said flag is set, reading contents of said location; (f) after reading said contents, clearing said flag for said location; (g) checking a flag for a next location; and (h) repeating steps (e) through (g) until every location in said table has been read.

The following background publications provide additional detail regarding possible implementations of the disclosed embodiments, and of modifications and variations thereof. All of these publications are hereby incorporated by reference: Tom Shanley, Pentium Pro Processor System Architecture, Mindshare (1997); James Foley, et alii, Computer Graphics Principles and Practice, Addison-Wesley (1996); Richard Ferraro, Programmer's Guide to the EGA and VGA Cards, Addison-Wesley (1990); Clive Maxfield and Alvin Brown, Bebop Bytes Back, Doone Publications (1997); Pentium II XEON Processor, Intel Corp. (1998); Intel Architecture Software Developer's Manual vols. 1–3, Intel Corp. (1998); P6 Family of Processors Hardware Development Manual, Intel Corp. (1998); AGP Design Guide, Intel Corp. (1998); AGP Pro Specification, Intel Corp. (1998); Jim Chu and Frank Hady, Maximizing AGP Performance, Intel Corp. (1998).

Modifications and Variations

As will be recognized by those skilled in the art, the innovative concepts described in the present application can be modified and varied over a tremendous range of applications, and accordingly the scope of patented subject matter is not limited by any of the specific exemplary teachings given. In particular, although FIG. 1 shows the FIFO 110 and table structure 120 internal to the graphics processor 100, in alternate embodiments either or both may be implemented external to the graphics processor 100.

In another modification, the table structure could be implemented in software. However, this would not be as efficient as the hardware embodiment because the data would have to be written to memory, o reordered, and then read by the graphics processor. The graphics processor would not be able to start its read operation until all the data had been written to memory. The overhead associated with the writes a required by a software implementation would make software slower than hardware.

In another modification, granularity of the dynamic write-order organizer can be reduced or increased if needed. The preferred embodiment advantageously works with partial evictions at a granularity of thirty-two bits (the partial eviction must be four bytes) because commands to the graphics processor are generally thirty-two bits wide. In other words, the preferred embodiment requires a partial eviction to be at least thirty-two bits wide because the table location is thirty-two bits wide. The minimum size of a partial eviction is determined by software, and thus under the programmer's control. A change in partial eviction granularity may require a corresponding change in dynamic write-order organizer granularity.

What is claimed is:

1. A dynamic reordering system, comprising:

a buffer functionally connected to receive data from a processor; and a dynamic reordering structure functionally connected to receive data from said buffer and dynamically reorder said data according to corresponding tags, wherein said structure will not permit out-of-order reads.

2. The dynamic reordering system of claim 1, wherein said buffer is a FIFO.

3. The dynamic reordering system of claim 1, wherein said dynamically reordered data is stored in a table.

4. The dynamic reordering system of claim 1, wherein said dynamic reordering structure comprises a table.

5. The dynamic reordering system of claim 1, wherein said dynamic reordering structure comprises write order logic.

6. The dynamic reordering system of claim 1, wherein said dynamic reordering structure comprises read logic.

7. The dynamic reordering system of claim 1, wherein said dynamic reordering structure comprises lockup detection logic.

8. The dynamic reordering system of claim 1, wherein said dynamic reordering structure incorporates a status flag for each datum received, whereby each status flag indicates whether said datum has been written to a table.

9. A dynamic write-order organizer, comprising:

a buffer structure, having an input and an output; and a table structure, having a plurality of entry locations functionally connected to said output of said buffer structure, whereby every write evicted from a write-combine buffer can be stored in one of said entry locations;

wherein said table structure incorporates a status flag for each of said entry locations and access circuitry to read said flag and block out-of-order reads.

10. The dynamic write-order organizer of claim 9, wherein each of said plurality of entry locations corresponds to a write location in said write-combine buffer, whereby contents of said write location having an offset from a base address in said write-combine buffer are stored at said entry location having said offset from a first entry location.

11. The dynamic write-order organizer of claim 9, wherein said table structure incorporates a status flag for each entry location, whereby each status flag indicates whether information has been written to its associated location.

12. A graphics processor, comprising:

a video graphics core; and at least one input structure functionally connected to said video graphics core;

wherein said input structure is a dynamic write-order organizer, said dynamic write-order organizer incorporating a table having a status flag for each table entry location and access circuitry to read said flag and block out-of-order reads.

13. The graphics processor of claim 12, wherein said dynamic write-order organizer incorporates a safety check, whereby lockup caused by programming errors can be detected and avoided.

14. The graphics processor of claim 12, wherein said access circuitry incorporates write logic, whereby table entries that have not been read are prevented from being overwritten.

15. The graphics processor of claim 12, wherein said access circuitry incorporates read logic, whereby table entries that have not been written are prevented from being read.

16. A graphics adapter, comprising:

a graphics processor incorporating a dynamic write-order organizer; and on-board memory;

wherein said dynamic write-order organizer incorporates a table having a status flag for each table entry location and access circuitry to read said flag and block out-of-order reads.

17. The graphics adapter of claim 16, wherein said dynamic write-order organizer incorporates a safety check, whereby lockup caused by programming errors can be detected and avoided.

18. The graphics adapter of claim 16, wherein said access circuitry incorporates write logic, whereby table entries that have not been read are prevented from being overwritten.

19. The graphics adapter of claim 16, wherein said access circuitry incorporates read logic, whereby table entries that have not been written are prevented from being read.

20. The graphics adapter of claim 16, wherein said on-board memory incorporates read-only memory containing video BIOS.

21. The graphics adapter of claim 16, wherein said on-board memory incorporates dynamic random-access memory.

22. A computer system, comprising:

a user input device;

at least one microprocessor which is operatively connected to receive inputs from said input device and incorporates at least one write-combine buffer;

a memory which is accessible by the microprocessor;

a data output device for displaying information, functionally connected to said microprocessor;

a magnetic disk drive which is operatively connected to the microprocessor; and a dynamic write-order organizer, for reordering out-of-order evictions from said write-combine buffer and preventing out-of-order reads, operatively connected between said microprocessor and said data output device.

23. The computer system of claim 22, wherein said data output device is a computer monitor.

24. The computer system of claim 22, wherein said data output device is a computer graphics adapter.

25. A method of reconstructing the order of writes to a write-combine buffer, comprising the steps of:

(a.) receiving data into a buffer from a write-combine buffer;

(b.) writing said data from said buffer into a table entry location, according to address tags;

(c.) after writing to a table location, setting a flag to indicate that information has been loaded into said location;

(d.) beginning at a first location, checking whether its flag is set;

(e.) if said flag is set, reading contents of said location;

(f.) after reading said contents, clearing said flag for said location;

(g.) checking a flag for a next location; and (h.) repeating steps (e) through (g) until every location in said table has been read.

26. The method of claim 25, further comprising the steps of:

(a.) when preparing to write to said table, if said write stalls, testing the flags of all entries in said table in a region between the stalled write location and a location presently being read; and (b.) if a false flag is detected in said region (i.) resetting flags for all table locations to false; and (ii.) restarting said read at said first location in said table;

wherein said false flag represents a location to which a write has not been made.

27. The method of claim 25, further comprising the step of:

(a.) after all table locations have been read, restarting said read at said first location in said table.

* * * * *